US005775231A

United States Patent [19]

Kammerhofer et al.

[11] Patent Number: 5,775,231

[45] Date of Patent: Jul. 7, 1998

[54] RAIL VEHICLE WITH CROSSBEAM ELASTICALLY HELD TO UNDERCARRIAGE

[75] Inventors: Gerd Kammerhofer, Kaisheim; Friedrich Werner, Wangen; Thomas Brendel, Treuchtlingen; Max Huber, Baeumenheim, all of Germany

[73] Assignee: ABB Daimler-Benz Transportation (Deutschland) GmbH, Hennigsdorf, Germany

[21] Appl. No.: 749,767

[22] Filed: Nov. 20, 1996

[30] Foreign Application Priority Data

Nov. 25, 1995 [DE] Germany ..... 195 44 030.7

[51] Int. Cl.[6] ..... B61D 17/00

[52] U.S. Cl. ..... 105/413; 105/199.1; 105/419

[58] Field of Search ..... 105/413, 414, 105/417, 419, 418, 422, 425, 452, 199.1; 296/182, 204

[56] References Cited

U.S. PATENT DOCUMENTS

| | | | |
|---|---|---|---|
| 1,691,723 | 11/1928 | Keys | 105/452 |
| 1,884,372 | 10/1932 | Symington | 105/422 |
| 1,895,368 | 1/1933 | Blackhall | 105/452 |
| 2,009,614 | 7/1935 | Geyer | 105/452 |
| 2,272,639 | 2/1942 | Jack | 105/422 |
| 2,925,051 | 2/1960 | Sluys | 105/452 |
| 4,352,520 | 10/1982 | Stiglmaier et al. | 105/422 |

FOREIGN PATENT DOCUMENTS

| | | | |
|---|---|---|---|
| 0489294A1 | 6/1992 | European Pat. Off. . | |
| 243248 | 2/1987 | Germany | 105/422 |
| 288 801 | 4/1991 | Germany . | |
| 865021 | 4/1961 | United Kingdom | 105/452 |

*Primary Examiner*—Mark Tuan Le
*Attorney, Agent, or Firm*—Spencer & Frank

[57] ABSTRACT

A rail vehicle has a longitudinal direction and includes an undercarriage, a crossbeam held against the undercarriage, extending transversely to the longitudinal direction of the superstructure and adapted for being seated on a bogie or similar structure. A mechanism is provided for elastically holding the crossbeam to the undercarriage.

13 Claims, 3 Drawing Sheets

RAIL VEHICLE WITH CROSSBEAM ELASTICALLY HELD TO UNDERCARRIAGE

CROSS-REFERENCE TO RELATED APPLICATIONS

This application claims the right of priority of Application No. 195 44 030.7 filed in Germany on Nov. 25, 1995, the disclosure of which is incorporated herein by reference.

BACKGROUND OF THE INVENTION

The invention relates to a rail vehicle having a superstructure including an undercarriage having at least one crossbeam extending transversely to a longitudinal direction of the superstructure and seated on a bogie or carriage provided near an end of the superstructure.

It is known from European application EP 0 489 294 A1 to provide a rail vehicle undercarriage of a superstructure with a crossbeam which extends transversely to the longitudinal direction of the superstructure and is held to the undercarriage for being seated on a bogie. The crossbeam is rigidly screwed directly to the sole bars which are components of the undercarriage that support the car floor and which extend in the longitudinal direction of the superstructure. The drawback of this arrangement is that vibrations from the undercarriage and the superstructure, which are fixedly coupled, is that, in accordance with vibration principles, running noises and impact noises are transmitted directly into the superstructure. The screw connections are thereby subjected to significantly high mechanical stresses.

SUMMARY OF THE INVENTION

It is an object of the invention to provide measures for a rail vehicle of the type first described above in order to achieve an improved decoupling between the undercarriage and the superstructure with respect to vibrations and impacts.

The above and other objects are accomplished in accordance with the invention by the provision of a rail vehicle, comprising: a superstructure having a longitudinal direction and including an undercarriage; a crossbeam held against the undercarriage and extending transversely to the longitudinal direction of the superstructure and adapted for being seated on a bogie or carriage; and means for elastically holding the crossbeam to the undercarriage.

In one embodiment of a rail vehicle of the invention, in which an elastically deformable element is provided between the crossbeam and the superstructure, not only is the transmission of acoustical forces and other vibrational forces from the undercarriage to the superstructure damped, but abruptly-occurring forces are initially absorbed by the elastically deformable element and transmitted gently, i.e. to a reduced extent, over the surface of the superstructure. Consequently, the mechanism for connecting the crossbeam to the undercarriage is no longer acted upon by peak forces, which significantly reduces the danger of tearing or breakage. In addition, a mutual influence of the undercarriage and the superstructure is reduced significantly by a decoupling with respect to vibrations. Moreover, the introduction of the forces originating from the bogie into the superstructure-undercarriage structure can be effected in a defined manner corresponding to stability requirements, by means of which anticipated mechanical vibration peaks can be damped.

In accordance with one aspect of the invention, the elastically deformable element is clamped, preferably with a prestress, between a holder at the crossbeam and a counterholder on the undercarriage. In particular, mechanical clamping means are provided so that the mechanical prestress of the elastically deformable element can be adapted to the given stress and vibration relationships. If the counterholder is disposed such that the crossbeam is only pressed, by means of the elastically deformable element, against sole bars extending in the longitudinal direction of the superstructure and associated with the undercarriage, an additional elastic layer is inserted between the respective sole bar and the associated section of the crossbeam. Like the elastically deformable element, this elastic layer can comprise a material that possesses high internal friction. This results in an additional, highly effective vibration damping. The holder on the crossbeam is preferably configured as an angled profile into which a elastically deformable element is inserted as an elastic block, comprised of, for example, a rubber material. The elastic block is supported on the counterholder rigidly connected to the superstructure. The holder and counterholder are angular, and receive between them the elastic block, so that the elastic block is mechanically encompassed on four sides. Displacement of the elastic block is also reliably prevented by the insertion of a prestress plate between at least one or both of the legs of the counterholder, which plate can be pressed more or less against the elastic block by means of screws in order to set the prestress of the elastic block.

Since the forces primarily transmitted between the bogie and the superstructure are oriented in the longitudinal direction of the superstructure, it is advisable to secure counterholders to the sole bars, in front of and behind the respective crossbeam. By way of the elastic block, these counterholders serve to support the crossbeam connected to the undercarriage. In this instance, a counterholder can extend from one sole bar to the other sole bar, transversely to the longitudinal direction, and be secured to the sole bars, so that the holder and the rubber-elastic block can extend over the appropriate width. If the elastic block comprises a relatively soft material, it can be provided with a mass that is sufficient for the stresses and also permits an optimal adaptation to the stress capacity of the undercarriage by way of using the clamping plates.

It is also possible, however, to permit a counterholder and the associated holder with the elastic block, including the possibly necessary prestressing means, to extend parallel to a sole bar and to secure the counterholder to the relevant sole bar. It can also be useful to provide the holder and/or the counterholder with a U-profiled block and clamp the block therein. The elastic element and the elastic layer can also be connected to each other in one piece, which can be particularly practical in an arrangement along a sole bar that includes a counterholder.

The invention is described in detail below in conjunction with drawings illustrating an embodiment of the invention.

DETAILED DESCRIPTION OF THE INVENTION

Figure 1:
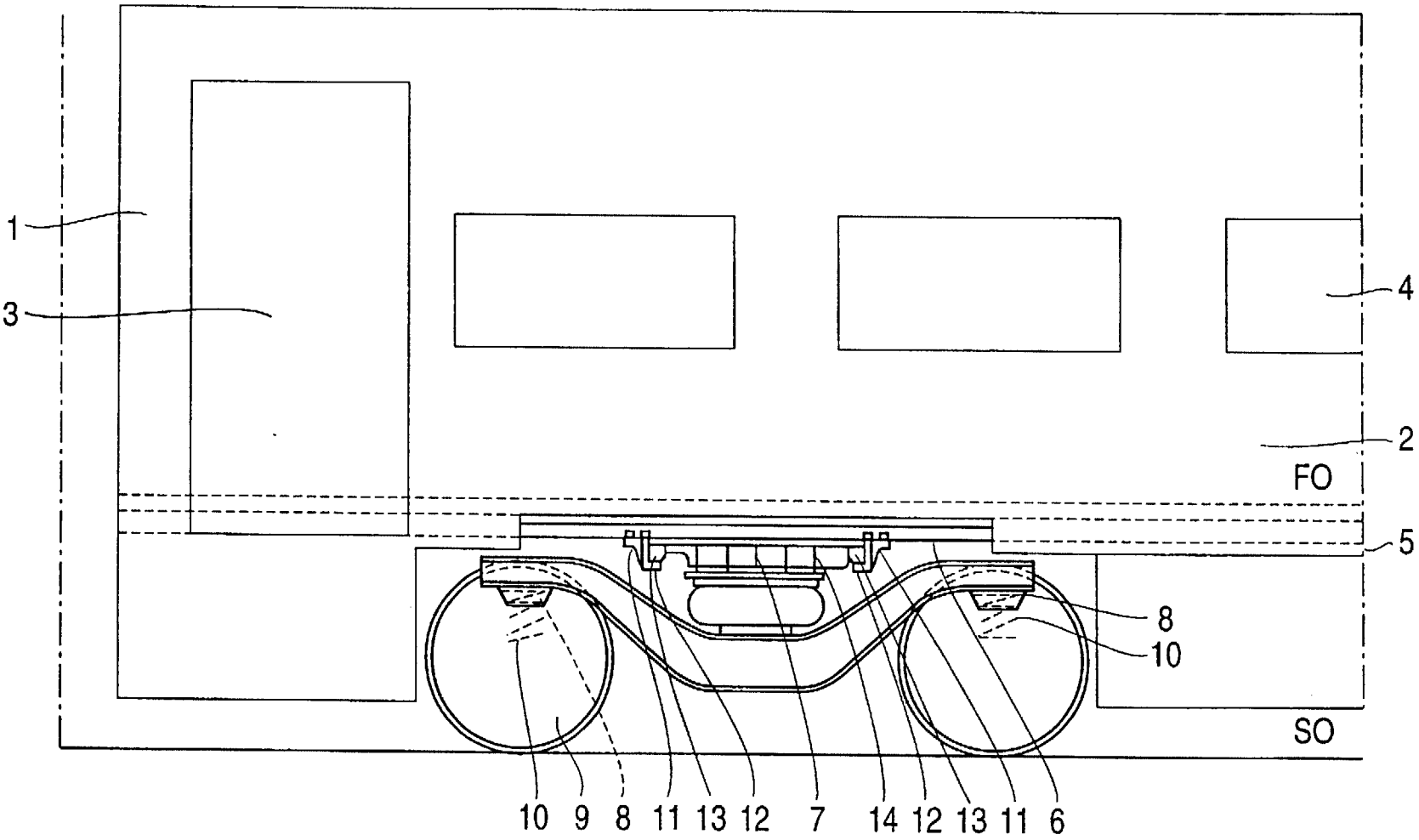
FIG. 1 is a side elevation which shows a partial representation of a rail vehicle configured as a passenger car, the vehicle having sole bars, crossbeam and a bogie in accordance with the invention.
Figure 2:
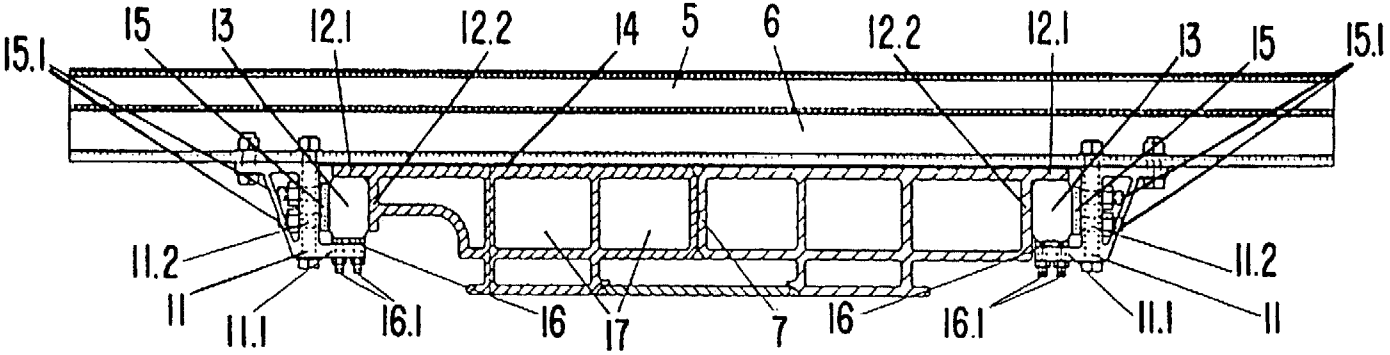
FIG. 2 is an enlarged partial side view of FIG. 1 which shows the arrangement in the region of the crossbeam with fastening means.
Figure 3:
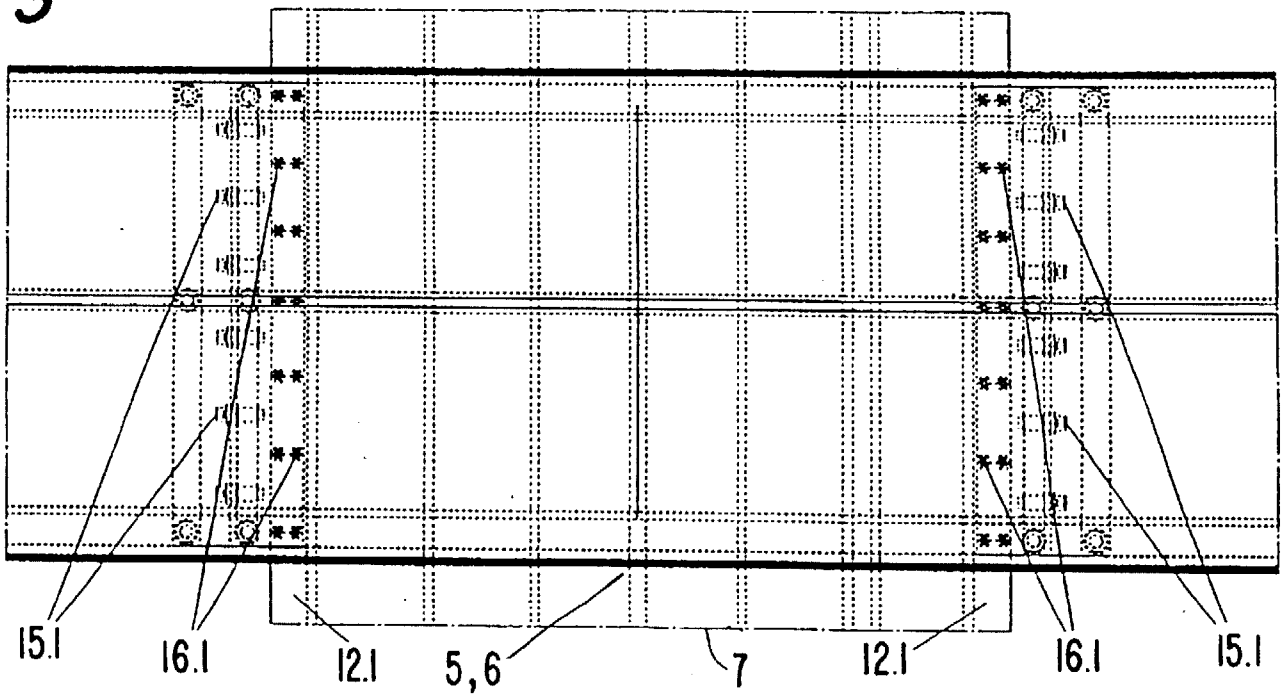
FIG. 3 is an elevational view of FIG. 2 from below.
Figure 5:
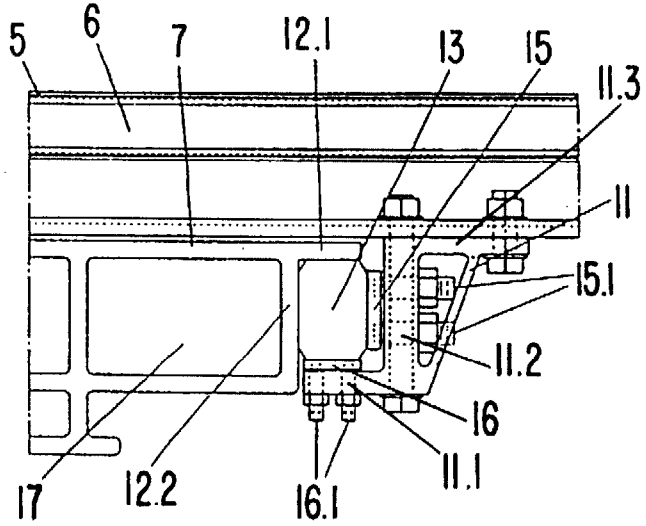
FIG. 5 is an enlarged partial side view of FIG. 1 in the region of the holder and counterholder.
Figure 4:
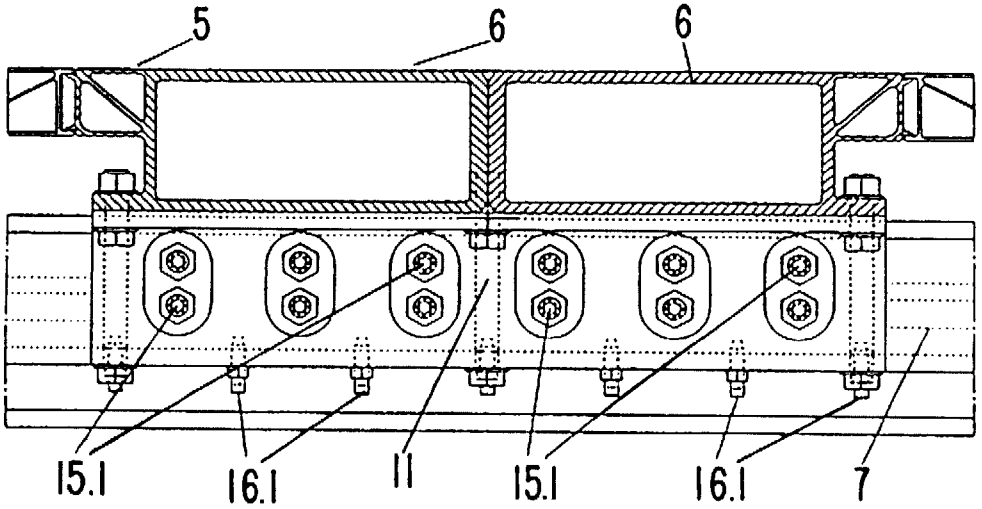
FIG. 4 is an end view of FIG. 2 showing the fastening means for the crossbeam.

Referring to FIG. 1, there is shown a rail vehicle 1, configured as a passenger car, having a superstructure 2 with a door 3 and windows 4. Superstructure 2 has an undercarriage 5 which supports the passable floor of superstructure 2 and includes sole bars 6 that extend in the longitudinal direction of superstructure 2 in the outer region of the longitudinal sides. Sole bars 6 (in most cases, two) extend parallel to one another. In a region between the ends of superstructure 2, a crossbeam 7 extends from one sole bar 6 to the other and is held to them transversely to the longitudinal direction. A carriage or bogie, indicated at 8, is disposed beneath crossbeam 7. The carriage or bogie 8 has wheels 9, which are held, either themselves or by their axles, to the bogie by means of springs 10.

To relieve the connection between the respective crossbeam 7 and the associated sole bars 6 with respect to the peak loads occurring during operation, and achieve an effective decoupling of vibrations and/or noise between bogie 8 and superstructure 2, crossbeam 7 is held elastically to undercarriage 5. Counterholders 11 are disposed in front of and behind crossbeam 7 in the longitudinal direction. Each counterholder is located opposite and spaced from the respective holder 12 at the front and back of the crossbeam, and secured to sole bars 6 as connecting means for the elastic connection between crossbeam 7 and undercarriage 5. An elastic element 13, in the form of an elastic or rubber block, is clamped between holders 12 and counterholders 11 and presses crossbeam 7 against the respectively associated sole bar 6. An elastic layer 14 is additionally inserted between the respective sole bar 6 and the adjacent region of the crossbeam 7 in order to damp noise and vibrations and absorb impact stresses. Like elastic element 13, layer 14, which is configured as a strip, preferably comprises a material that has high internal friction and possesses good shock-absorbing and vibration-damping properties. In particular, an elastomer or other rubber-elastic material, possibly with added metal plates or tissues, is used. Because of the internal friction, a portion of the energy is converted into heat and thus dissipated without being transmitted to the superstructure.

Holder 12 is configured as an angled section which is formed on crossbeam 7 and into which an elastic block is inserted as elastic element 13. This block is supported on its other side against counterholder 11. The angled profile of the holder 12 on crossbeam 7 has an angle leg 12.1 disposed parallel to the plane of sole bar 6, and an angle leg 12.2 leading away at a right angle from sole bar 6. Angle leg 12.1 rests against sole bar 6 by way of elastic layer 14. Counterholder 11 is spaced from holder 12 and includes holding rails 11.1 and 11.2 which extend parallel to the angle legs 12.1 and 12.2, respectively. Elastic element 13 is clamped with mechanical prestress between these legs and rails. To change the mechanical prestress of the elastic element 13 in order to adapt to different stress situations and compensate for or balance out tolerances, an adjusting device is inserted between counterholder 11 and elastic element 13. Alternatively or additionally, this adjusting device can also be associated with holder 12. In the present embodiment, prestress plates 15 and 16, respectively, which engage the free ends of prestress screws 15.1 and 16.1, respectively, are provided at holding rails 11.1 and 11.2 of counterholder 11. The prestress screws 15.1 and 16.1 are screwed into the holding rails 11.1 or 11.2 of the counterholder 11. By screwing in the screws, the free cross section for the elastic element 13 is narrowed, and elastic element 13 is therefore set with respect to its elastic properties to correspond to the requirements, particularly regarding supporting force. As a result of the arrangement of a holding apparatus 11, 12, 13 in front of and behind crossbeam 7, the high stresses occurring particularly in the direction of travel are directly absorbed by counterholders 11 extending transversely to the direction of travel, permitting only slight relative movement of crossbeam 7. Counterholder 11 can extend from one sole bar 6, transversely to the longitudinal direction, to the other sole bar 6, so crossbeam 7 is supported over its entire width transverse to the direction of travel, and elastic element 13 extending over the same width can have a volume which is necessary for the considerable forces. Holders 12, the respective prestress plates 15, 16 and the associated, elastic block 13 accordingly extend parallel to the associated counterholder 11.

For additional utility, crossbeam 7 can also be equipped with integrated compressed-air chambers 17, in which compressed air can be stored for operating brakes for bogie 8.

A definable force distribution for central and outer support, as well as a mechanical decoupling between the carriage and the passenger compartment, are achieved with the invention, and the elastic connection between crossbeams and sole bars can meet the high requirements for noise-free travel. The bogie and superstructure are optimally decoupled with respect to vibrations, with an optimum distribution of forces introduced through the bogie. The elastic connection reduces the force effects acting on the superstructure and the associated connecting means, which significantly reduces the force level overall. A great advantage is that the introduction of the forces from the bogie into the support structure of the superstructure is effected in a defined manner, according to the requirements regarding stability, and the tension peaks to be anticipated during operation can be intercepted. Moreover, acoustical impedance from structure-borne noise volume is reduced by the interposition of the spring elements.

The invention has been described in detail with respect to preferred embodiments, and it will now be apparent from the foregoing to those skilled in the art that changes and modifications may be made without departing from the invention in its broader aspects, and the invention, therefore, as defined in the appended claims is intended to cover all such changes and modifications as fall within the true spirit of the invention.

What is claimed is:

1. A rail vehicle, comprising:

a superstructure having a longitudinal direction and including an undercarriage, the undercarriage including at least two sole bars which extend parallel to one another in the longitudinal direction of the superstructure;

a crossbeam held against the undercarriage, extending transversely to the longitudinal direction of the superstructure and adapted for being seated on a bogie or carriage; and means for elastically holding the crossbeam to the undercarriage, the holding means including holders provided at the crossbeam, counterholders secured to the sole bars adjacent a respective one of the holders and elastically-deformable elements inserted, respectively, between each counterholder and adjacent holder.

2. A rail vehicle as defined in claim 1, and further comprising an elastic layer inserted between the crossbeam and the undercarriage.

3. A rail vehicle as defined in claim 2, wherein the elastic layer is inserted between the crossbeam and sole bars.

4. A rail vehicle as defined in claim 1, wherein the elastically deformable element comprises an elastic block and each said holder has an angled profile into which the elastic block is inserted, the elastic block having a side supported against the adjacent counterholder.

5. A rail vehicle as defined in claim 4, wherein the angled profile of the holder has an angle leg disposed parallel to a plane of the sole bars and is adjacent to this plane, and an angle leg that extends downwardly perpendicular and away from the plane of the sole bars; the counterholder has holding rails that extend parallel to and spaced from the angle legs, respectively, and the elastic block is clamped between the angle legs and the holding rails.

6. A rail vehicle as defined in claim 5, further comprising at least one adjustable prestress plate inserted between the elastic block and at least one of the counterholder and the holder.

7. A rail vehicle as defined in claim 6, wherein the at least one prestress plate comprises a plurality of prestress plates disposed, respectively, between the holding rails of the counterholder and the elastic block.

8. A rail vehicle as defined in claim 6, and further including prestress screws having free ends engaging the at least one prestress plate and presently readily accessible headed ends.

9. A rail vehicle as defined in claim 6, wherein the crossbeam has front and back ends with respect to the longitudinal direction, the holders are provided at the front and back ends of the crossbeam, the counterholders are secured to the sole bars, respectively, in front of and behind the crossbeam in the longitudinal direction and spaced from the adjacent holders with the elastically deformable elements being disposed between the adjacent holders and counterholders.

10. A rail vehicle as defined in claim 9, wherein each counterholder, respectively, extends transversely to the longitudinal direction, from one sole bar to the other sole bar and has opposite ends secured to the respective sole bar.

11. A rail vehicle as defined in claim 10, wherein the holder, the prestress plates, respectively, and the elastic block extend parallel to the counterholder.

12. A rail vehicle as defined in claim 2, wherein at least one of the elastic element and the elastic layer comprises an elastic material that has a high internal friction.

13. A rail vehicle, comprising:

a superstructure having a longitudinal direction and including an undercarriage;

a crossbeam held against the undercarriage, extending transversely to the longitudinal direction of the superstructure and adapted for being seated on a bogie or carriage;

means for elastically holding the crossbeam to the undercarriage; and compressed-air chambers integrated into the crossbeam.

* * * * *